United States Patent [19]

Salvino

[11] Patent Number: 4,623,141

[45] Date of Patent: Nov. 18, 1986

[54] HAND HELD ARM AND HAND MUSCLE BUILDER

[76] Inventor: Lawrence P. Salvino, 23557 Milton Rd., Wauconda, Ill. 60084

[21] Appl. No.: 728,349

[22] Filed: Apr. 29, 1985

[51] Int. Cl.[4] ..... A63B 21/14

[52] U.S. Cl. ..... 272/68; 272/140; D21/198

[58] Field of Search ..... 272/67, 68, 128, 132, 272/135, 140, 141, 142; 623/50, 53; D21/198

[56] References Cited

U.S. PATENT DOCUMENTS

| | | | |
|---|---|---|---|
| 1,623,869 | 4/1927 | Giraldi | D21/198 X |
| 2,714,008 | 7/1955 | Urban | 272/137 |
| 2,806,699 | 9/1957 | Spooner | 272/140 |
| 3,645,256 | 2/1972 | Morrison | D21/198 X |
| 3,921,975 | 11/1975 | Pridgen | 272/140 |
| 4,093,211 | 6/1978 | Hughes et al. | 272/68 |
| 4,208,047 | 6/1982 | Olsen | 272/67 |
| 4,343,465 | 8/1982 | Allen | 272/67 |

FOREIGN PATENT DOCUMENTS

| | | | |
|---|---|---|---|
| 39613 | 11/1907 | Switzerland | 272/140 |

*Primary Examiner*—Richard J. Apley
*Assistant Examiner*—David J. Brown
*Attorney, Agent, or Firm*—William A. Snow

[57] ABSTRACT

A hand held exercise device for strengthening the hand and arm muscles with means to vary the resistance having a pair of handles one of each of said handles secured to one end of a coiled spring, a flexible tube with the coil of the spring and an axial rod positioned in the coil and extending beyond both ends thereof threaded on both ends containing washers and wingnuts on the threaded ends of the rod.

1 Claim, 5 Drawing Figures

HAND HELD ARM AND HAND MUSCLE BUILDER

BACKGROUND OF THE INVENTION

A hand held, spring loaded exercise device with a stiff, three coiled spring, the end of which extends outwardly and downwardly, and each covered with a handle for movement together by the fingers and thumb is old and has no means to control the resistance on the coiled spring to increase strength required by the fingers to close the handles together, and it was to overcome this deficiency that the present invention was conceived.

SUMMARY OF THE INVENTION

An arm and hand muscle builder having a stiff, coiled spring, the ends of which extend outwardly and downwardly angularly and each is provided with a handle, the invention comprising a flexible tube positioned in the interior of said spring and means to expand said tube to provide additional tension of said spring whereby additional power is required to force said handles toward each other.

DETAILED DESCRIPTION OF THE DRAWINGS

Figure 1:
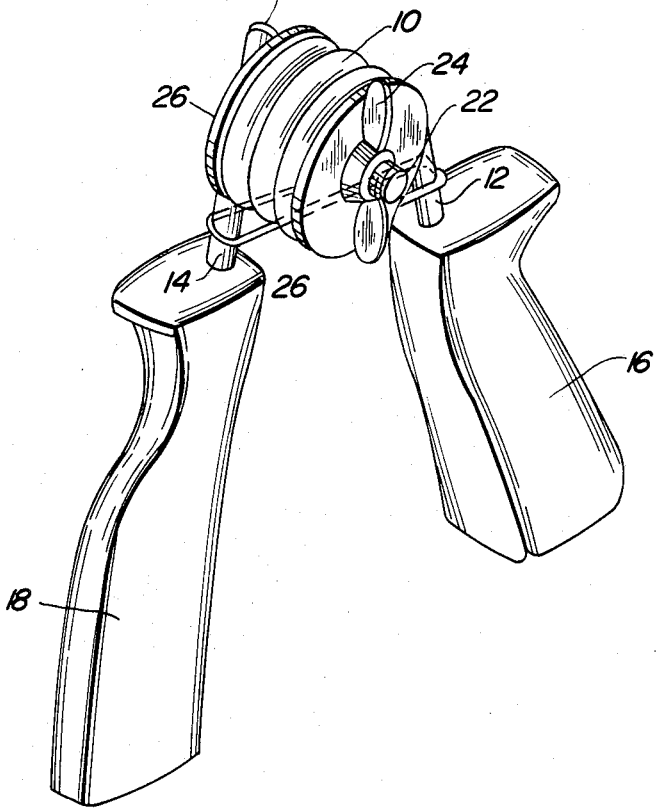
FIG. 1 is a perspective view of the device of the present invention.
Figure 2:
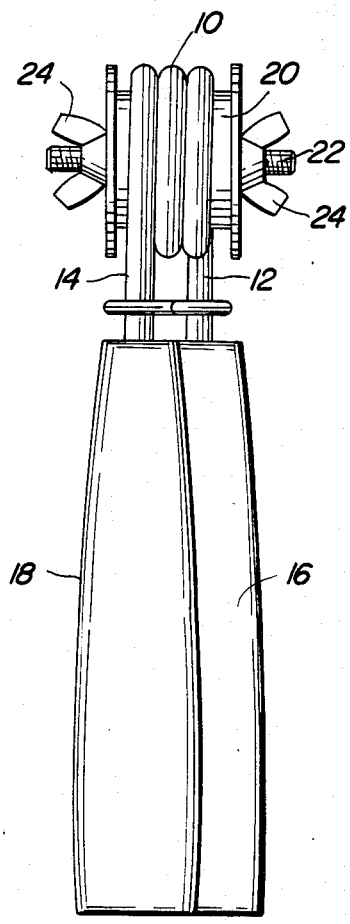
FIG. 2 is a side elevational view thereof.
Figure 3:
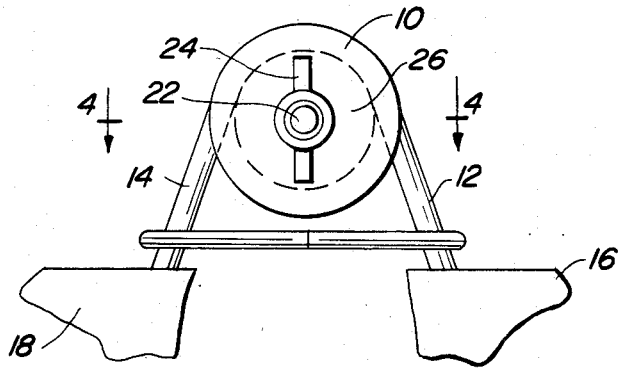
FIG. 3 is an end elevational view of the tensioning means with parts of the handle broken away.
Figure 4:
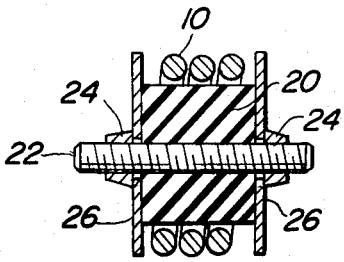
FIG. 4 is a cross-sectional view taken on the lines 4—4 of FIG. 3 and showing the tensioning means in relaxed position.
Figure 5:
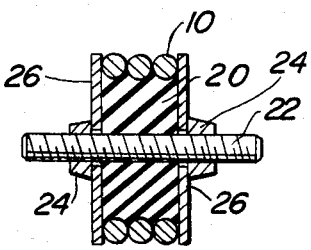
FIG. 5 is a cross-sectional view taken on the lines 4—4 of FIG. 3 but showing resistance applied to the spring coil.

A hand held exercise device having a heavy coiled spring 10 with the ends thereof 12, 14 extending outwardly and downwardly angularly and each having a handle 16, 18 thereon. This device is old and on the market.

To increase the resistance on the coiled spring 10, a tube of flexible material 20 of a length longer than the coiled spring 10 is housed interiorly of the spring coil. The material may be rubber or any flexible material such as certain plastics or fabrics.

A rod 22 is positioned axially in said tube 20 and threaded at both ends and the rod extends outwardly of the flexible material at both ends.

Preferably wingnuts 24 and washers 26 are applied to the threaded ends of the rod whereby, upon turning the nuts 24 on the threaded ends of the rod, the washers will squeeze the tube 20 together and exert pressure on the coiled spring 10 to increase the resistance thereon and make it harder to squeeze the handles 16, 18 together and therefore make the exercise device more efficient.

It will be understood that any means to squeeze the flexible material together against the coiled spring comes within the scope of this invention.

Although but one embodiment is herein shown and described, it is to be understood that details may be altered or omitted without departing from the spirit of this invention as defined by the following claims.

I claim:

1. An exercise device for exercising the arms and hands and held in one hand comprising a heavy coiled spring having two ends which extend downwardly and angularly outwardly, said ends provided with handles, a tube of flexible material extending through the interior of said coiled spring, a rod extending through said tube and said rod threaded on both ends, and a pair of nuts and washers respectively received on each of said threaded ends for drawing said tube of flexible material together to increase the resistance of said coiled spring.

* * * * *